US009285821B2

(12) United States Patent
Maeda et al.

(10) Patent No.: US 9,285,821 B2
(45) Date of Patent: Mar. 15, 2016

(54) NEGATIVE REFERENCE VOLTAGE GENERATING CIRCUIT AND NEGATIVE REFERENCE VOLTAGE GENERATING SYSTEM USING THE SAME

(71) Applicant: POWERCHIP TECHNOLOGY CORPORATION, Hsin-Chu (TW)

(72) Inventors: Teruaki Maeda, Hsin-Chu (TW); Nobuhiko Ito, Hsin-Chu (TW)

(73) Assignee: POWERCHIP TECHNOLOGY CORPORATION, Hsin-Chu (TW)

( * ) Notice: Subject to any disclaimer, the term of this patent is extended or adjusted under 35 U.S.C. 154(b) by 0 days.

(21) Appl. No.: 14/513,852

(22) Filed: Oct. 14, 2014

(65) Prior Publication Data

US 2015/0355665 A1 Dec. 10, 2015

(30) Foreign Application Priority Data

Jun. 5, 2014 (JP) ..... 2014-116632

(51) Int. Cl.
*G05F 3/08* (2006.01)
*G05F 3/26* (2006.01)

(52) U.S. Cl.
CPC . *G05F 3/262* (2013.01); *G05F 3/26* (2013.01)

(58) Field of Classification Search
CPC ..... G05F 3/262; G05F 3/26
See application file for complete search history.

(56) References Cited

U.S. PATENT DOCUMENTS 6,031,397 A 2/2000 Banba
6,242,898 B1 6/2001 Shimizu et al.
6,930,537 B1 8/2005 Ceekala et al.
7,511,568 B2 * 3/2009 Kimura ..... G05F 3/30 327/538
2004/0233600 A1 11/2004 Yoshida et al.
2006/0043957 A1 * 3/2006 Carvalho ..... G05F 3/30 323/313
2006/0044877 A1 3/2006 Kato
2006/0125460 A1 * 6/2006 Mheen ..... G05F 3/262 323/313
2008/0018318 A1 1/2008 Hsu
2009/0066313 A1 * 3/2009 Kimura ..... G05F 3/262 323/313
2009/0080281 A1 3/2009 Hashiba (Continued)

FOREIGN PATENT DOCUMENTS

JP 10-239357 A 9/1998
JP 2000-267749 A 9/2000

(Continued)

OTHER PUBLICATIONS

Oguey et al., "MOS Voltage Reference Based on Polysilicon Gate Work Function Difference", IEEE Journal of Solid-State Circuits, Jun. 1980, vol. SC-15, No. 3, pp. 264-269.

(Continued)

*Primary Examiner* — Jung Kim
(74) *Attorney, Agent, or Firm* — Birch, Stewart, Kolasch & Birch, LLP

(57) ABSTRACT

A negative reference voltage generating circuit includes a clamp-type reference voltage circuit and a differential amplifier. The clamp-type reference voltage circuit is connected between a node of a first negative voltage which is equal to or lower than the ground voltage and a node of a second negative voltage which is lower than the first negative voltage, and is formed by connecting a first circuit and a second circuit in parallel. The differential amplifier amplifies the difference between a node voltage in the first circuit and a node voltage in the second circuit, and outputs a negative reference voltage.

12 Claims, 10 Drawing Sheets

(56) References Cited

U.S. PATENT DOCUMENTS

| | | | |
|---|---|---|---|
| 2012/0155168 | A1 | 6/2012 | Kim et al. |
| 2012/0218032 | A1 | 8/2012 | Nadimpalli |

FOREIGN PATENT DOCUMENTS

| | | | |
|---|---|---|---|
| JP | 2000-339047 | A | 12/2000 |
| JP | 2002-367374 | A | 12/2002 |
| JP | 2004-350290 | A | 12/2004 |
| JP | 2009-16929 | A | 1/2009 |
| JP | 2009-74973 | A | 4/2009 |
| WO | WO 2006/025099 | A1 | 3/2006 |

OTHER PUBLICATIONS

Stanescu et al., "High PSRR CMOS Voltage Reference for Negative LDOS", Catalyst Semiconductor Romania S.R.L., Bucharest, Romania, Catalyst Semiconductor Inc.. Sunnyvalc, USA, 2004, pp. 311-314.

* cited by examiner

NEGATIVE REFERENCE VOLTAGE GENERATING CIRCUIT AND NEGATIVE REFERENCE VOLTAGE GENERATING SYSTEM USING THE SAME

CROSS REFERENCE TO RELATED APPLICATIONS

This application claims priority of Japanese Patent Application No. 2014-116632, filed on Jun. 5, 2014, the entirety of which is incorporated by reference herein.

BACKGROUND OF THE INVENTION

1. Field of the Invention

The present invention relates to a negative reference voltage generating circuit used in, for example, a NOR-type flash memory to generate a negative reference voltage, and a negative reference voltage generating system using the same.

2. Description of the Related Art

FIGS. 6A and 6B are cross section views of a NOR-type flash memory according to Conventional Example 1. FIGS. 6A and 6B respectively show necessary voltages for performing programming/erasing operations by Fowler-Nordheim tunneling with the maximum voltages 18V and 10V. In FIGS. 6A and 6B, 100 is a semiconductor substrate, 101 is a control gate, 102 is a source, 103 is a drain, and 104 is a floating gate.

For example, an NOR type flash memory needs high-speed performance on random access. As shown in FIGS. 6A and 6B, a positive middle voltage such as 10V and a negative middle voltage such as −8V are adopted to substitute for a positive high voltage to perform programming/erasing operations. By using the positive middle voltage and negative middle voltage, MOS transistors in peripheral circuits show higher performance than high-voltage transistors. The reason is that a thin gate oxide film and a short gate length can be used.

To generate positive voltages, a bandgap reference voltage generating circuit is often used, for example, in the peripheral circuits of an NAND type flash memory.

The prior art documents are listed as follows:

Patent document 1: US 2012-0218032
Patent document 2: JP 2009-016929
Patent document 3: JP 2009-074973
Patent document 4: US 2008-0018318
Patent document 5: JP H10-239357
Patent document 6: JP 2000-339047
Patent document 7: JP 2002-367374
Patent document 8: US 2012-155168
Patent document 9: WO 2006-025099
Patent document 10: JP 2004-350290

Non-patent document 1: Comel Stanescu et al., "High PSRR CMOS Voltage Reference for Negative IDOS", Proceedings of 2004 International Semiconductor Conference (CAS 2004), 27$^{th}$ Edition, Oct. 4-6, 2004, in Sinaia, Romania.

Non-patent document 2: Oguey et al., "MOS Voltage Reference Based on Polysilicon Gate Work Function Difference", IEEE Journal of Solid-State Circuits, Vol. SC-15, No. 3, June 1980.

However, to generate negative voltages, the bandgap reference voltage generating circuit for generating negative voltages as described above is not usually used. It is common for the bandgap reference voltage generating circuits of positive voltage to be used to generate a negative reference voltage as shown in FIGS. 7 and 8.

FIG. 7 is a circuit diagram showing a negative voltage generator 2 disclosed in Patent document 1 according to Conventional Example 2. In FIG. 7, the negative voltage generator 2 is composed of resistors R21, R22, a differential amplifier 20, and a charge pump 21. Here, Vdd is a positive supply voltage, Vss is a ground voltage, and the positive supply voltage Vpp applied to the resistor R1 is regulated according to the positive reference voltage PVref. The negative voltage Vneg which is generated by the negative voltage generator 2 of FIG. 7 is obtained from the following equation:

$$Vneg=-R22/R21\times Vpp+(1+R22/R21)\times PVref \quad (1)$$

FIG. 8 is a circuit diagram showing a negative voltage generating circuit disclosed in Patent documents 2 and 3 according to Conventional Example 3. In FIG. 8, the negative voltage generating circuit is composed of differential amplifier 31 and 32, p-channel MOS transistors (called PMOS transistors in the following description) P31 and P32, resistors R31 and R32, and a charge pump 33. Here, Vdd is a positive supply voltage, Vss is a ground voltage. The PMOS transistors P31 and P32 compose a current mirror and make the same reference current flow through the resistors R31 and R32. The negative voltage Vneg which is generated by the negative voltage generating circuit of FIG. 8 is shown as the following equation:

$$Vneg=-Iref\times R32+PVref \quad (2)$$

$$Iref=PVref/R31 \quad (3)$$

However, if a negative reference voltage NVref can be used, a more precise negative voltage Vneg can be generated and the circuit structure can be simple. To generate a negative voltage Vneg=−10V, if the negative reference voltage NVref=−1.0V+0.1V, the negative voltage Vneg will be controlled at −10V+1V which has an error tenfold that of the negative reference voltage NVref. Therefore, the negative voltage generating circuit needs an accuracy of ±0.01V, the same as the bandgap reference generating circuit.

FIG. 9 is a circuit diagram showing a negative voltage generating circuit according to this concept, the structure of which is the same as a positive voltage generating circuit which uses a positive reference voltage. The negative voltage generating circuit of FIG. 9 is composed of resistors R41 and R42, a differential amplifier 41, and a charge pump 42. In FIG. 9, the resistors R41 and R42 which compose a voltage divider circuit can be replaced by a series circuit of two capacitors. Here, The negative voltage Vneg which is generated from the negative voltage generating circuit of FIG. 9 is shown as the following equation:

$$Vneg=(R42/R41+1)\times NVref \quad (4)$$

The problem is how to realize a circuit which accurately generates the negative reference voltage NVref. FIG. 10 is a circuit diagram showing a negative reference voltage generating circuit according to Conventional Example 4. The negative reference voltage generating circuit of FIG. 10 is composed of a current source 50 which generates reference current Iref according to the positive reference voltage PVref, resistors R51 and R52, and n-channel MOS transistors (called NMOS transistors in the following description) N51 and N52. The negative reference voltage NVref which is generated by the negative reference voltage generating circuit of FIG. 10 is shown as the following equation:

$$NVref=Iref\times R52 \quad (5)$$

FIG. 11 is a circuit diagram showing a negative reference voltage generating circuit according to Conventional Example 5. The negative reference voltage generating circuit of FIG. 11 is composed of resistors R61 and R62, and a differential amplifier 60. The negative reference voltage NVref which is generated by the negative reference voltage generating circuit of FIG. 11 is shown as the following equation:

$$NVref=-PVref\times R62/R61 \quad (6)$$

Regarding the control circuits of Conventional Examples, the negative reference voltage is obtained from the positive reference voltage, and this can cause some errors in addition to an inaccuracy of the positive reference voltage PVref. The control circuits of Conventional Examples are classified as two types.

(Type 1 (FIG. 10)) A reference current Iref is generated from the positive reference voltage PVref, and the negative reference voltage NVref is generated by the equation Iref×R according to the reference current Iref (for example, Patent document 4). In this case, the operation conditions are not exactly the same because a current mirror is used. Therefore, there are more errors involved. Moreover, there is an unnecessary offset of the differential amplifier involved.

(Type 2 (FIG. 11)) Using the comparator circuit between the negative reference voltage NVref and the positive reference voltage PVref, the negative reference voltage NVref is generated by inverting the positive reference circuit PVref generated as antenna power. In this case, the positive reference voltage PVref is used as the power source, leading to errors due to generation of the positive reference voltage PVref for the power source and errors of its voltage-drop due to the fact that current is being drawn.

Further, in Patent document 10, in order to provide a bandgap reference voltage generator which doesn't need a trimming circuit, a reference voltage generator unit is used. However, a heat-sensing circuit using diadodes is necessary to realize the reference voltage generator unit, and this makes the circuit structure more complicated. Note that the bandgap reference voltage generator is, for example, a positive reference voltage generator of 1.25V, but not a circuit for generating negative reference voltage.

In order to solve the above problems, the invention provides a negative reference voltage generating circuit and a negative reference voltage generating system which can more accurately generate a negative reference voltage and have a simple circuit structure compared to the prior art.

BRIEF SUMMARY OF THE INVENTION

A detailed description is given in the following embodiments with reference to the accompanying drawings.

The invention provides a negative reference voltage generating circuit that includes a clamp-type reference voltage circuit and a differential amplifier. The clamp-type reference voltage circuit is connected between a node of a first negative voltage, which is a ground voltage or lower than the ground voltage and a node of a predetermined second negative voltage, which is lower than the first negative voltage. The clamp-type reference voltage circuit is formed by connecting a first circuit and a second circuit in parallel. The first circuit is formed by connecting a first resistor, a plurality of first PMOS transistors which are connected in parallel, and a second resistor in series. The second circuit is formed by connecting a second PMOS transistor and a third resistor in series. The first resistor and the source of the second PMOS transistor are connected to the node of the first negative voltage, and the second resistor and the third resistor are connected to the node of the second negative voltage. The differential amplifier has an output terminal connected to the gates of the plurality of first PMOS transistors and the gate of the second PMOS transistor, wherein the differential amplifier amplifies the difference between a voltage of a node connecting the drains of the plurality of first PMOS transistors with the second resistor and a voltage of a node connecting the drain of the second PMOS transistor with the third resistor, and outputs a predetermined negative reference voltage.

In the negative reference voltage generating circuit, the size of the plurality of first PMOS transistors and the size of the second PMOS transistor are substantially the same.

In the negative reference voltage generating circuit, the clamp-type reference voltage circuit further includes: a fourth resistor inserted between the ground voltage and the node of the first negative voltage; and a fifth resistor inserted between a node connecting the second resistor with the third resistor, and a node of a third negative voltage which is lower than the second negative voltage.

The negative reference voltage generating circuit further includes: a buffer amplifier which buffers and amplifies the output of the differential amplifier and outputs it, wherein the gates of the plurality of first PMOS transistors and the gate of the second PMOS transistor are connected to an output terminal of the buffer amplifier instead of the output terminal of the differential amplifier.

In the negative reference voltage generating circuit, the second resistor and the third resistor are both formed from a diode-connected MOS transistor.

The invention also provides a negative reference voltage generating system including: a negative voltage generator which generates a negative voltage according to a positive reference voltage or generates a negative voltage in response to a predetermined control signal; and the negative reference voltage generating circuit described above, which uses the negative voltage generated from the negative voltage generator as the second negative voltage or the third negative voltage to generate the negative reference voltage.

The negative reference voltage generating system further includes: a trimming circuit which converts the negative reference voltage generated from the negative reference voltage generating circuit into another negative reference voltage and outputs it.

The negative reference voltage generating system further includes a starter circuit, which applies a predetermined negative voltage to the drains of the plurality of the first PMOS transistors when the power is switched on.

According to the invention, a negative reference voltage generating circuit and a negative reference voltage generating system are provided, which can generate a negative reference voltage more accurately in comparison with the prior art and have a simple circuit structure.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
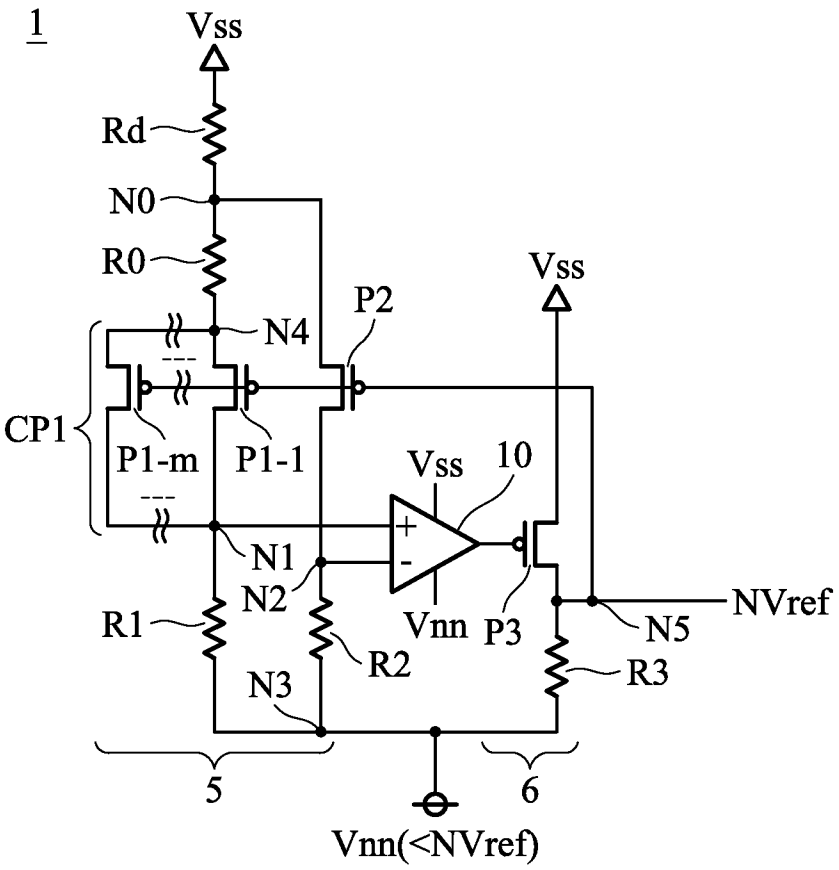
FIG. 1 is a circuit diagram showing a negative reference voltage generating circuit according to an embodiment of the invention.

FIG. 1 is a circuit diagram showing a negative reference voltage generating circuit 1 according to an embodiment of the invention. The negative reference voltage generating circuit 1 of the invention comprises a clamp-type reference voltage circuit 5, a differential amplifier 10 which is formed from, for example, an operational amplifier, and a buffer amplifier 6. Here, the clamp-type reference voltage circuit 5 comprises resistors Rd, R0, R1, and R2, a transistor circuit CP1 which is formed by connecting m PMOS transistors P1-1~P1-*m* in parallel, and a PMOS transistor P2. Here, In the transistor circuit CP1, each corresponding electrode of the PMOS transistors P1-1~P1-*m* are connected together, and it is preferred that PMOS transistors P1-1~P1-*m* and P2 are substantially formed with the same size. Vss is a ground voltage (=0V) and Vnn is a predetermined voltage of a negative voltage source.

In FIG. 1, the resistor Rd is an adjustment resistor for a stable level, wherein one end of the resistor Rd is connected to the ground voltage Vss and the other end is connected to a node NO. The node NO is connected to a node N4 via the resistor R0 which is used for stabilizing the negative reference voltage. The node N4 is connected to each source of the PMOS transistors P1-1~P1-*m* of the transistor circuit CP1. Each drain of the PMOS transistors P1-1~P1-*m* is connected to a node N1. Each gate of the PMOS transistors P1-1~P1-*m* and the gate of the PMOS transistor P2 are connected together to a node N5. The node N1 is connected to a node N3 via the resistor R1. In addition, the node NO is connected to the source of the PMOS transistor P2 and, the drain of the PMOS transistor P2 is connected to the node N2 and to the node N3 via the resistor R2. Here, the voltage at the node N1 is applied to the non-inverting input terminal of the differential amplifier 10, and the voltage at the node N2 is applied to the inverting input terminal of the differential amplifier 10. The differential amplifier 10 amplifies the difference of the two input voltages and outputs it.

The differential amplifier 10 is connected to the predetermined voltage Vnn of the negative voltage source and the ground voltage Vss. The output terminal of the differential amplifier 10 is connected to the gate of a PMOS transistor P3. The source of the PMOS transistor P3 is connected to the ground voltage Vss, and the drain of the PMOS transistor P3 is connected to the node N5 and to the node N3 via the resistor R3. The node N3 is connected to the negative voltage Vnn of the negative voltage source.

Figure 2:
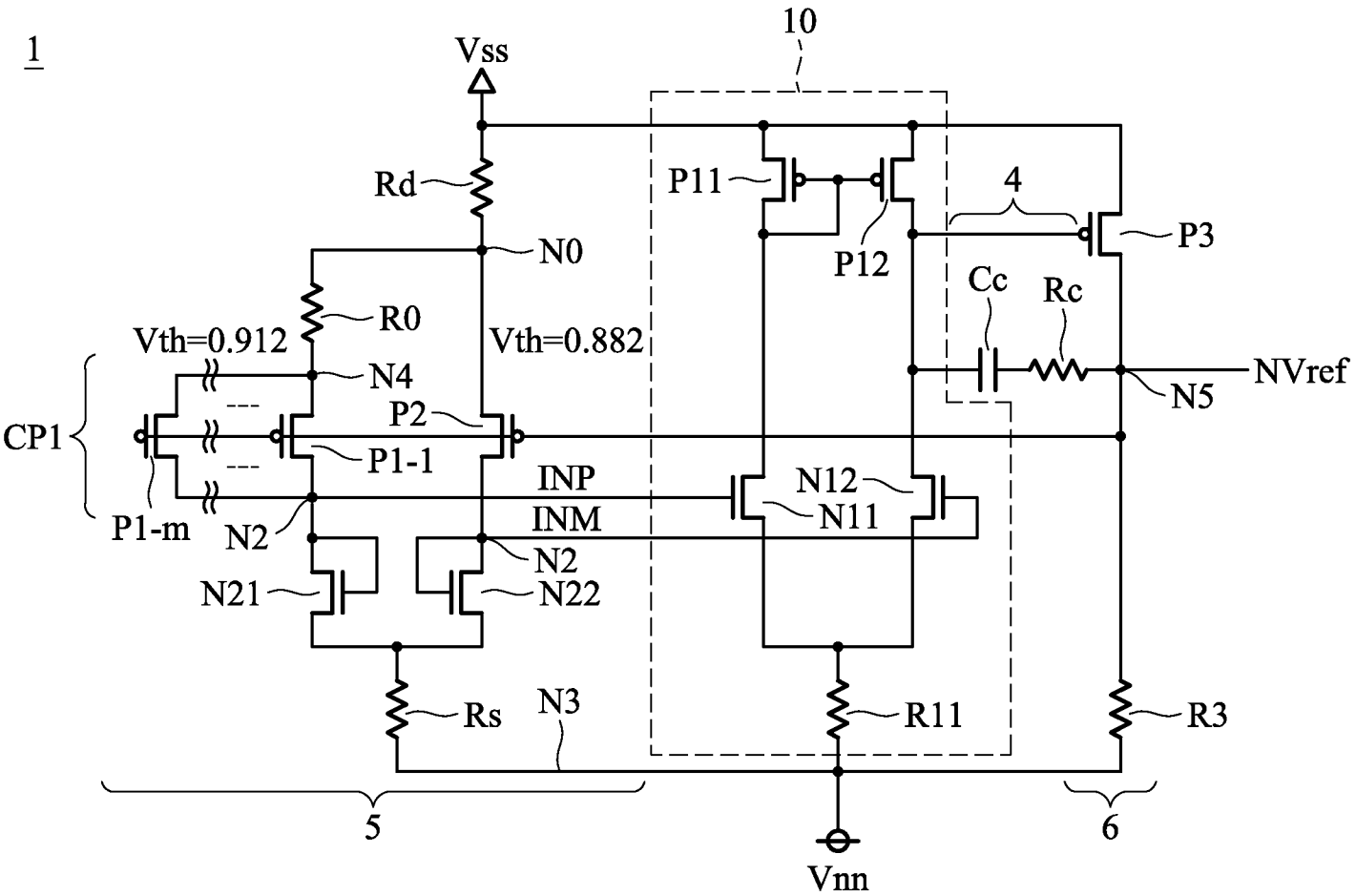
FIG. 2 is a circuit diagram showing a practical example of the negative reference voltage generating circuit of FIG. 1.

FIG. 2 is a circuit diagram showing a practical example of the negative reference voltage generating circuit of FIG. 1. The circuit of FIG. 2 has the following points that differ from the circuit of FIG. 1: (1) the differential amplifier 10 comprises PMOS transistors P11 and P12, NMOS transistors N11 and N12, and a resistor R11; (2) the resistor R1 is replaced by a resistor Rs and the diode-connected NMOS transistor N21 of which the drain and the gate are connected together; (3) the resistor R2 is replaced by a resistor Rs and the diode-connected NMOS transistor N22 of which the drain and the gate are connected together; and (4) a phase compensation circuit 4 formed from a series circuit of a capacitor Cc and a resistor Rc is connected between the output terminal of the differential amplifier 10 and the node N5.

If the NMOS transistors N21 and N22 are made on a P-type substrate, a triple well structure is necessary, and it is possible to change the NMOS transistors to PMOS transistors. Namely, the NMOS transistors N21 and N22 can be replaced by any diode-connected MOS transistor.

In the negative reference voltage generating circuit of FIGS. 1 and 2, the voltage of the node N1 is determined according to the voltage of the resistor R0 and the drain-source voltage of the transistor circuit CP1 which is formed by connecting m PMOS transistors P1-1~P1-*m* in parallel. The voltage of the node N2 is determined according to the drain-source voltage of the PMOS transistor P2. Those voltages are detected by the differential amplifier 10. The buffer amplifier 6 formed from the PMOS transistor P3 and the resistor R3 buffers and amplifies the output of the differential amplifier 10 and sends feedback to the gates of the PMOS transistors P1-1~P1-*m* and P2. In such a feedback control loop, the voltages of nodes N1 and N2 are controlled at the same level. At the same time, the voltage of the node N5, namely the negative reference voltage NVref, is controlled at a constant value which is independent of the power voltage. Although the voltage is dependent on the characteristics of the PMOS transistor, the temperature dependence can be cancelled and minimized by carefully choosing the size of the resistors R0 and Rd and the PMOS transistor. This is very important.

In this embodiment, the negative reference voltage NVref is generated by a new MOS reference voltage generating circuit. The negative voltage Vnn (<NVref) of the negative voltage source is generated (|Vnn|>|NVref|), and the MOS reference voltage generating circuit operates with the negative voltage Vnn of the negative voltage source and the ground voltage Vss. Here, the negative voltage Vnn of the negative voltage source is generated by a negative voltage pump and controlled by, for example, a negative voltage control circuit of the prior art.

Figure 3A:
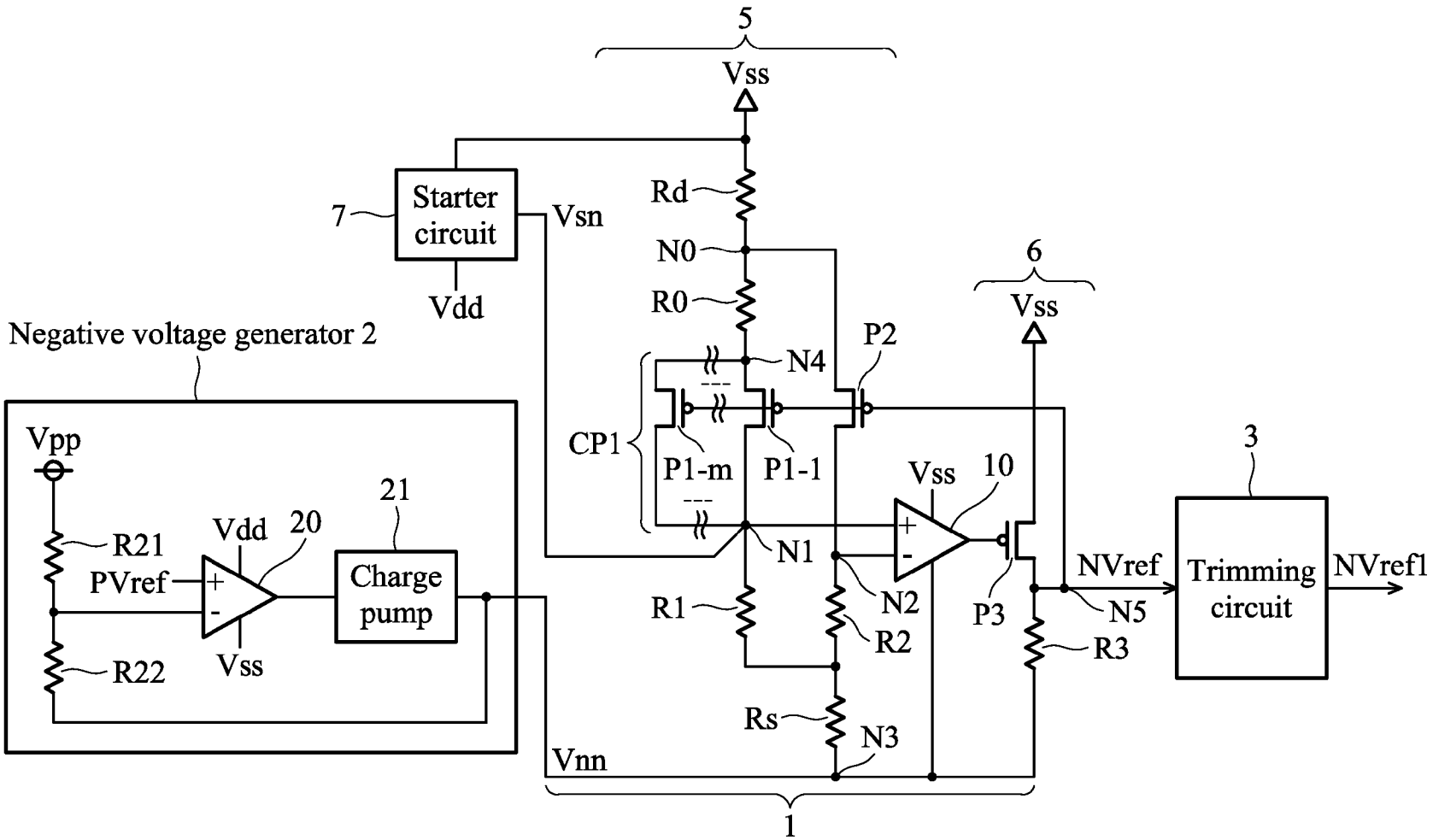
FIG. 3A is a circuit diagram showing a negative reference voltage generating system using the negative reference voltage generating circuit of FIG. 1.
Figure 7:
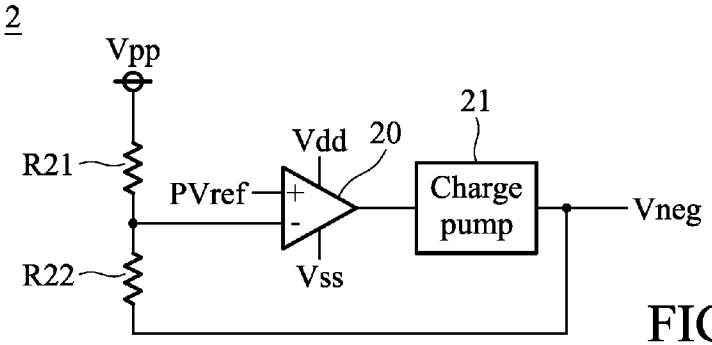
FIG. 7 ( PRIOR ART )
FIG. 7 is a circuit diagram showing a negative voltage generating circuit according to Conventional Example 2.
Figure 8:
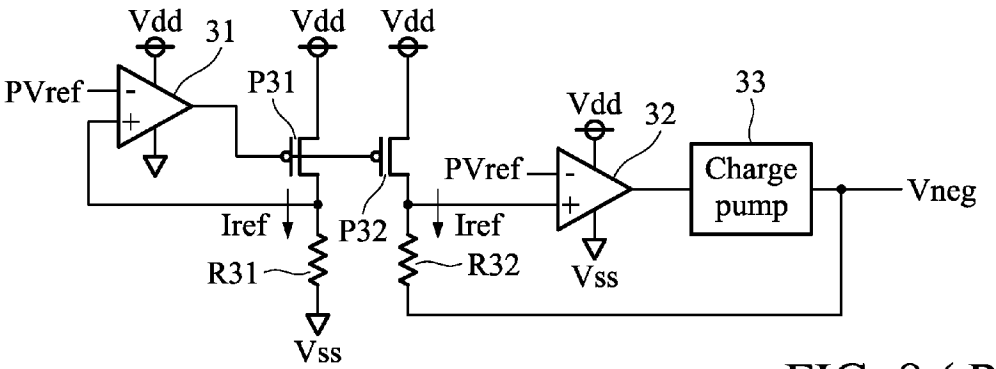
FIG. 8 ( PRIOR ART )
FIG. 8 is a circuit diagram showing a negative voltage generating circuit according to Conventional Example 3.
Figure 9:
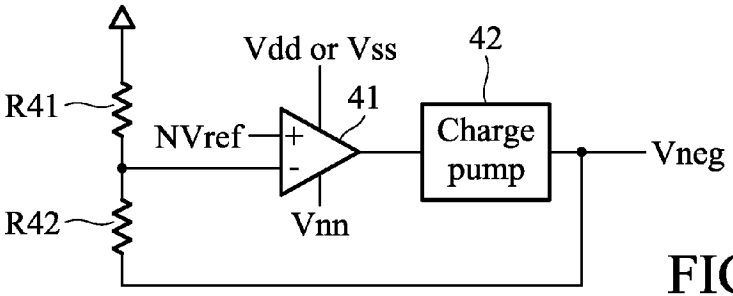
FIG. 9 ( PRIOR ART )
FIG. 9 is a circuit diagram showing an example of a negative voltage generating circuit using a negative reference voltage.
Figure 10:
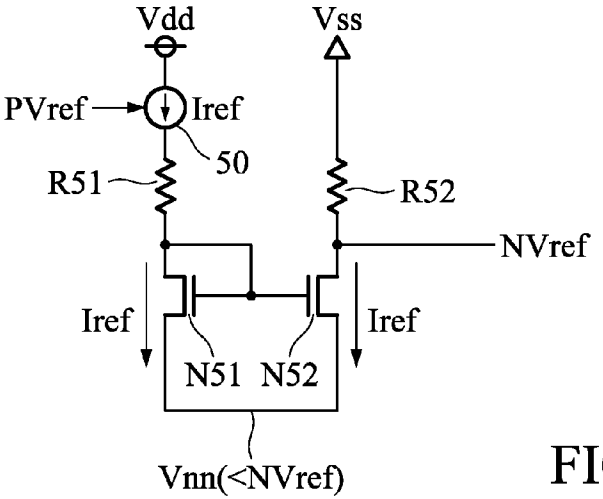
FIG. 10 ( PRIOR ART )
FIG. 10 is a circuit diagram showing a negative reference voltage generating circuit according to Conventional Example 4.
Figure 11:
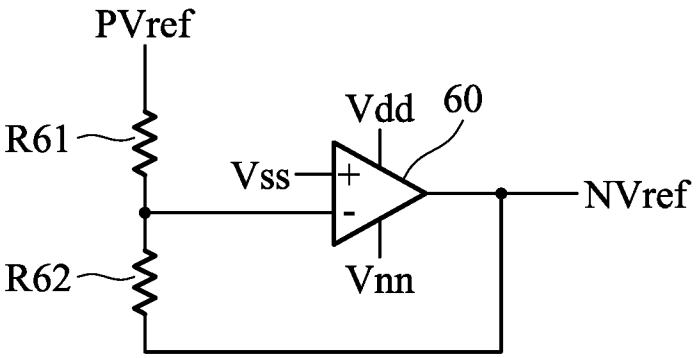
FIG. 11 ( PRIOR ART )
FIG. 11 is a circuit diagram showing a negative reference voltage generating circuit according to Conventional Example 5.

FIG. 3 is a circuit diagram showing a negative reference voltage generating system using the negative reference voltage generating circuit 1 of FIG. 1. In FIG. 3A, the negative reference voltage generating system comprises: (1) the negative voltage generator 2 of FIG. 7 which is a conventional circuit disclosed in Patent document 1 and generates a predetermined negative voltage according to the positive power voltage Vpp; (2) the negative reference voltage generating circuit 1 of FIG. 1 according the embodiment of the invention, which uses the negative voltage Vnn and the ground voltage Vss to generate the predetermined negative reference voltage NVref; (3) a starter circuit 7 which uses the positive power voltage Vdd and the ground voltage Vss to generate a predetermined negative voltage Vsn to be applied to the node N1 in order to immediately switch the transistor circuit CP1 of the clamp-type reference voltage circuit 5 to an operation state when the power is on; and (4) a trimming circuit 3 which converts the negative reference voltage NVref output from the negative reference voltage generating circuit 1 into a predetermined negative reference voltage NVref1(NVref1>NVref, or NVref1<NVref).

In comparison with the circuit of FIG. 1, the negative reference voltage generating circuit 1 of FIG. 3A further comprises the resistor Rs. The negative voltage generator 2 comprises the resistors R21 and R22, the differential amplifier 20, and the charge pump 21. Note that, to meet the requirements the starter circuit 7 is not indispensable.

Figure 3B:
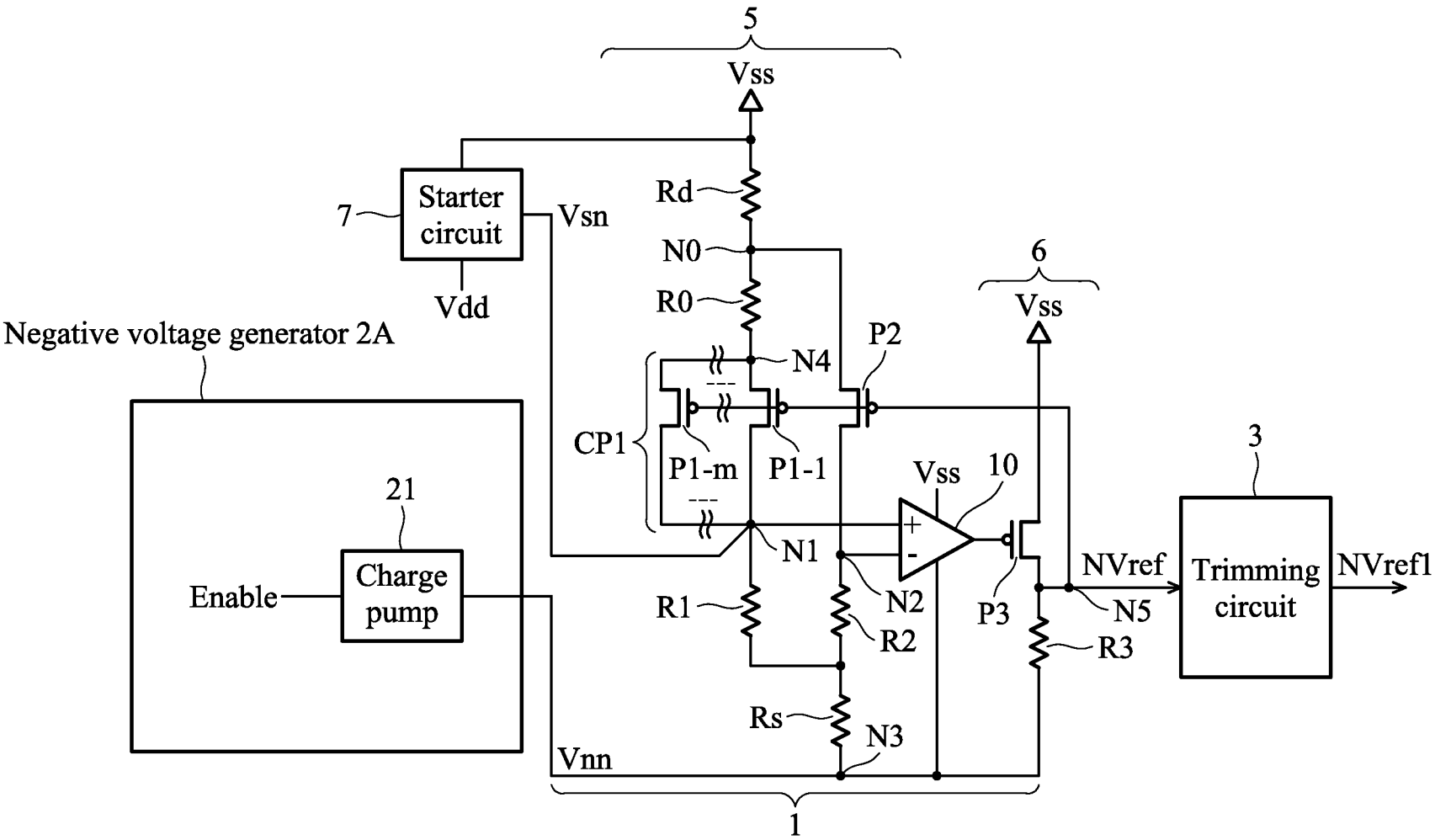
FIG. 3B is a circuit diagram showing a modification of the negative reference voltage generating system of FIG. 3A.

FIG. 3B is a circuit diagram showing a modification of the negative reference voltage generating system of FIG. 3A. In comparison with FIG. 3A, the negative reference voltage generating system of FIG. 3B replaces the negative voltage generator 2 with a negative voltage generator 2A. In FIG. 3B, the negative voltage generator 2A simply comprises a charge pump 21 which generates the negative voltage Vnn in response to an enable signal Enable which is a predetermined control signal. In this case, the negative voltage Vnn is determined according to a negative voltage which is determined by the power voltage, clock frequency, and consumption current of the negative reference voltage generating circuit 1. However, generally it is enough that the negative voltage is −2V~−3V. Therefore, if the power voltage of this semiconductor device is 1.8V or 3.0V, the output voltage of the charge pump 21 will not span across too wide a range, so there is no influence on the negative reference voltage NVref. Further, the starter circuit 7 can be omitted by referring to the negative reference voltage after a predetermined time period.

Figure 4:
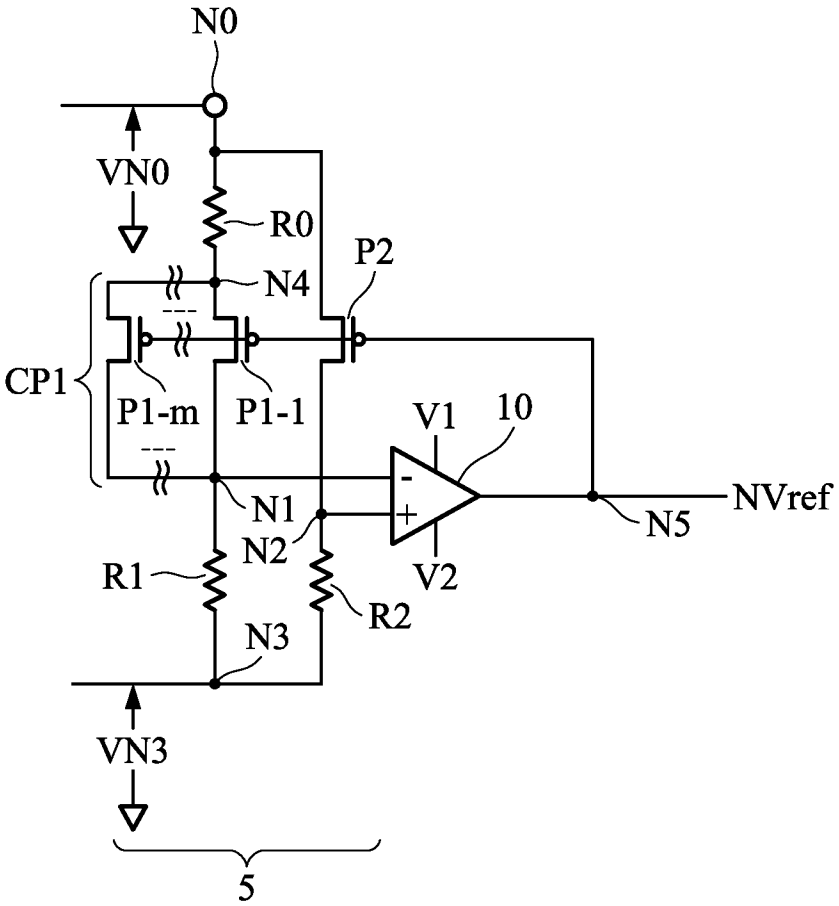
FIG. 4 is a circuit diagram showing a basic circuit of the negative reference voltage generating circuit of FIG. 1.

FIG. 4 is a circuit diagram showing a basic circuit of the negative reference voltage generating circuit 1 of FIG. 1. FIG. 4 shows the basic concept of the invention. The basic circuit of FIG. 4 has the following points that differ from the negative reference voltage generating circuit 1 of FIG. 1: (1) there is no resistor Rd (Namely, it is allowable to not provide the resistor Rd in the invention); and (2) There is no buffer amplifier 6 (Namely, it is allowable to not provide the buffer amplifier 6 in the invention).

Now, it is assumed that the supply voltage to the differential amplifier 10 is V1 and V2. In the basic circuit of FIG. 4, it is necessary to meet the following basic requirements, wherein 0V means the ground voltage.

$$N1>0V \tag{7}$$

$$V2<0V \text{ and } V2<VN0 \tag{8}$$

$$VN0\leq 0V \tag{9}$$

$$VN3<VN0 \tag{10}$$

In the basic circuit of FIG. 4, the following additional requirements can be added.

$$V1=0V \text{ or } Vdd \tag{11}$$

$$VN0=0V \tag{12}$$

Figure 5:
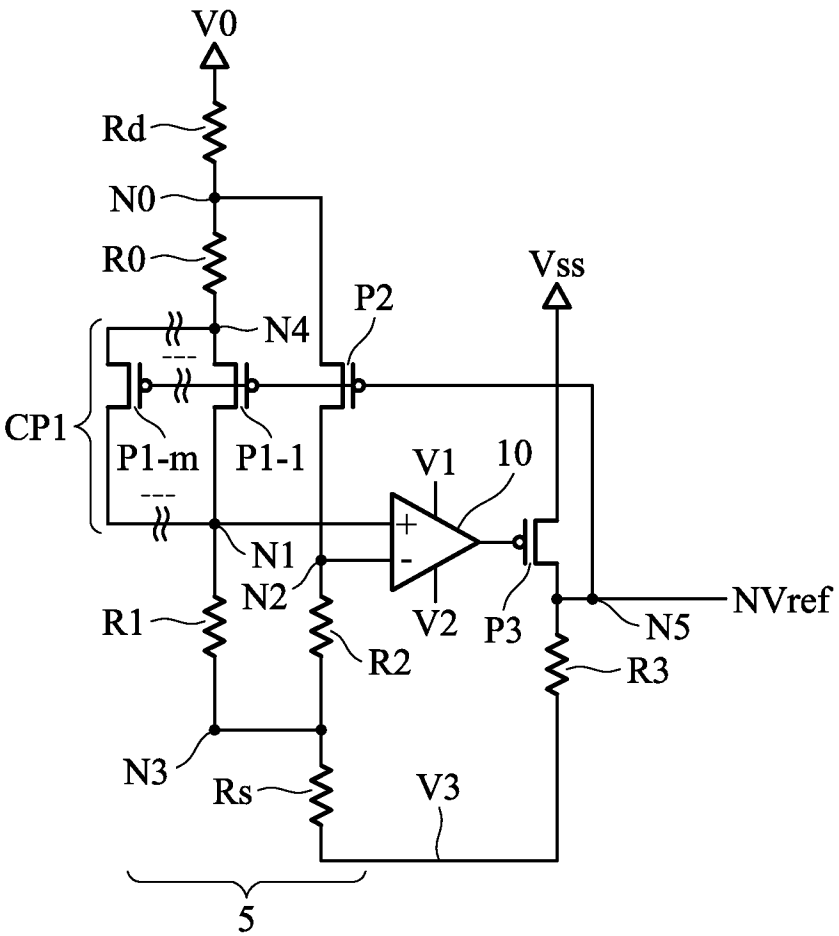
FIG. 5 is a circuit diagram showing an application circuit formed by adding a peripheral circuit to the basic circuit of FIG. 4.
Figure 6B:
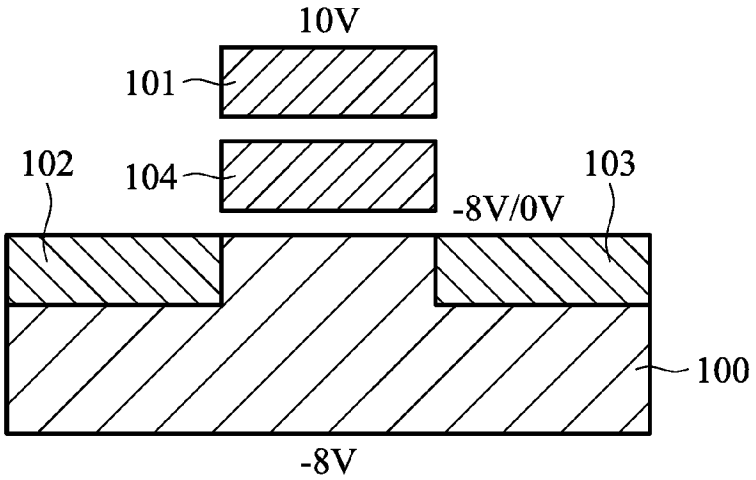
FIG. 6B ( PRIOR ART )
FIG. 6B is a cross section view of an NOR-type flash memory according to Conventional Example 1, which shows necessary voltages for performing programming/erasing operations by Fowler-Nordheim tunneling with a maximum voltage 10V.
Figure 6A:
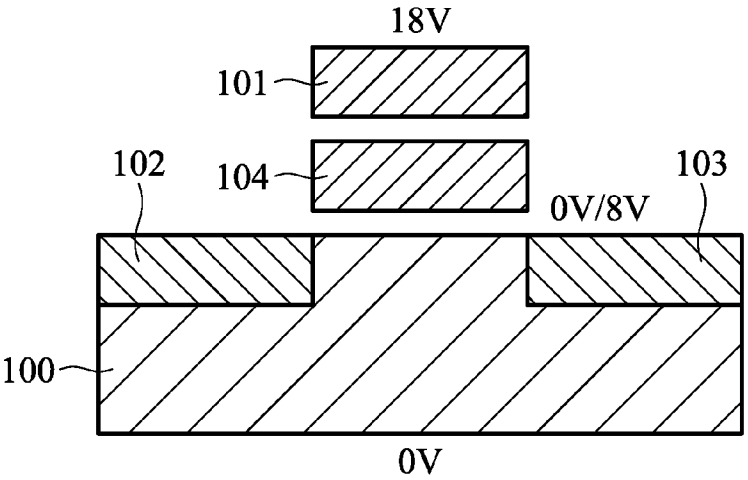
FIG. 6A ( PRIOR ART )
FIG. 6A is a cross section view of an NOR-type flash memory according to Conventional Example 1, which shows necessary voltages for performing programming/erasing operations by Fowler-Nordheim tunneling with a maximum voltage 18V.

The node NO can be connected to a node of V0=0V via the resistor Rd (FIGS. 1, 3, and 5).

$$VN3-1V \tag{13}$$

The voltage VN3 can be supplied from the charge pump 21 (FIG. 3). The node N3 can be connected to a the voltage N3, at which the voltage V3 is less than 0V, via the resistor Rs. The voltage VN3 of the node N3 can be controlled by the charge pump 21 (FIG. 3). The resistors R1 and R2 can be composed of a diode-connected MOS transistor. The circuit can further comprise the starter circuit 7 of FIG. 3. The generated negative reference voltage NVref can be output to a trimming circuit.

FIG. 5 is a circuit diagram showing an application circuit which is formed by adding a peripheral circuit to the basic circuit of FIG. 4. The application circuit of FIG. 5 has the same structure as the negative reference voltage generating circuit 1 of FIG. 3. From the requirement for the basic circuit of FIG. 4, it is necessary to meet the following basic requirements, wherein 0V means the ground voltage.

$$V0=0V \tag{14}$$

$$V10V \tag{15}$$

$$V2\leq -1V \tag{16}$$

$$V3\leq 1V \tag{17}$$

In the application circuit of FIG. 5, the following additional requirements can be added.

$$V1=0V \text{ or } Vdd \tag{18}$$

$$V2=V3 \tag{19}$$

The voltages V2 and V3 can be supplied from the charge pump 21 (FIG. 3). The voltages V2 and V3 can be controlled by the charge pump 21 (FIG. 3). The resistors R1 and R2 can be composed of a diode-connected MOS transistor. The circuit can further comprise the starter circuit 7 of FIG. 3. The generated negative reference voltage NVref can be output to a trimming circuit.

The negative reference voltage generating circuit 1 of the invention which has the aforementioned structure is manufactured experimentally, and it is compared with a circuit according to the prior art. The result is shown in the following table.

TABLE 1

| Variation of negative reference voltage | Embodiment | Current type according to prior art (non-Patent document 1) | Operational amplifier type according to prior art (non-Patent document 2) |
|---|---|---|---|
| Variation of transistors (FF/TT/SS) | 0.15 V | 0.62 V | 0.14 V |
| Temperature variation (−40~100° C.) | 5.6 mV | 22.3 mV | 149 mV |

From Table 1, the following things can be understood. Regarding the variations of transistors, the negative reference voltage generating circuit 1 of the embodiment has very little variation of negative voltage as the operational amplifier type circuit according to the prior art. However, regarding temperature variation, the variation of negative reference voltage can be substantially decreased in comparison with the prior art.

As described above, the negative reference voltage generating circuit and the negative reference voltage generating system using the same according to the invention can generate a precise negative reference voltage with high accuracy against temperature variation, and have a simple circuit structure.

As the aforementioned description, a negative reference voltage generating circuit and a negative reference voltage generating system are provided, which can generate a negative reference voltage more accurately in comparison with the prior art and have a simple circuit structure. The negative reference voltage generating circuit and the negative reference voltage generating system according to the invention are applicable to, for example, a non-volatile memory device such as a NOR-type flash memory, or a dynamic random access memory (DRAM), etc.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A negative reference voltage generating circuit, comprising:

a clamp-type reference voltage circuit which is connected between a node of a first negative voltage which is a ground voltage or lower than the ground voltage and a node of a predetermined second negative voltage which is lower than the first negative voltage, the clamp-type reference voltage circuit formed by connecting a first circuit and a second circuit in parallel, wherein the first circuit is formed by connecting a first resistor, a plurality of first PMOS transistors which are connected in parallel, and a second resistor in series, and the second circuit is formed by connecting a second PMOS transistor and a third resistor in series, wherein the first resistor and the source of the second PMOS transistor are connected to the node of the first negative voltage, and the second resistor and the third resistor are connected to the node of the second negative voltage; and a differential amplifier which has an output terminal connected to the gates of the plurality of first PMOS transistors and the gate of the second PMOS transistor, the differential amplifier amplifying the difference between a voltage of a node connecting the drains of the plurality of first PMOS transistors with the second resistor and a voltage of a node connecting the drain of the second PMOS transistor with the third resistor, and outputting a predetermined negative reference voltage.

2. The negative reference voltage generating circuit as claimed in claim 1, wherein the size of the plurality of first PMOS transistors and the size of the second PMOS transistor are substantially the same.

3. The negative reference voltage generating circuit as claimed in claim 1, wherein the clamp-type reference voltage circuit further comprises:

a fourth resistor inserted between the ground voltage and the node of the first negative voltage; and a fifth resistor inserted between a node connecting the second resistor with the third resistor, and a node of a third negative voltage which is lower than the second negative voltage.

4. The negative reference voltage generating circuit as claimed in claim 1, further comprising:

a buffer amplifier which buffers and amplifies the output of the differential amplifier and outputs it, wherein the gates of the plurality of first PMOS transistors and the gate of the second PMOS transistor are connected to an output terminal of the buffer amplifier instead of the output terminal of the differential amplifier.

5. The negative reference voltage generating circuit as claimed in claim 3, further comprising:

a buffer amplifier which buffers and amplifies the output of the differential amplifier and outputs it, wherein the gates of the plurality of first PMOS transistors and the gate of the second PMOS transistor are connected to an output terminal of the buffer amplifier instead of the output terminal of the differential amplifier.

6. The negative reference voltage generating circuit as claimed in claim 1, wherein the second resistor and the third resistor are both formed from a diode-connected MOS transistor.

7. A negative reference voltage generating system comprising:

a negative voltage generator which generates a negative voltage according to a positive reference voltage or generates a negative voltage in response to a predetermined control signal; and the negative reference voltage generating circuit as claimed in claim 1, which uses the negative voltage generated from the negative voltage generator as the second negative voltage to generate the negative reference voltage.

8. A negative reference voltage generating system comprising:

a negative voltage generator which generates a negative voltage according to a positive reference voltage or generates a negative voltage in response to a predetermined control signal; and the negative reference voltage generating circuit as claimed in claim 3, which uses the negative voltage generated from the negative voltage generator as the third negative voltage to generate the negative reference voltage.

9. The negative reference voltage generating system as claimed in claim 7, further comprising:

a trimming circuit, which converts the negative reference voltage generated from the negative reference voltage generating circuit into another negative reference voltage and outputs it.

10. The negative reference voltage generating system as claimed in claim 8, further comprising:

a trimming circuit, which converts the negative reference voltage generated from the negative reference voltage generating circuit into another negative reference voltage and outputs it.

11. The negative reference voltage generating system as claimed in claim 7, further comprising:

a starter circuit, which applies a predetermined negative voltage to the drains of the plurality of the first PMOS transistors when the power is switched on.

12. The negative reference voltage generating system as claimed in claim 8, further comprising:

a starter circuit, which applies a predetermined negative voltage to the drains of the plurality of the first PMOS transistors when the power is switched on.

* * * * *